United States Patent [19]

Koopmans et al.

[11] Patent Number: 4,760,741

[45] Date of Patent: Aug. 2, 1988

[54] BOREHOLE DILATOMETER WITH INTENSIFIER

[76] Inventors: Robert Koopmans, R.R. #2, Acton, Ontario, Canada, L7J 2L8; Robin W. Hughes, 65 Waterford Dr., TH 805, Weston, Ontario, Canada, M9R 2N7

[21] Appl. No.: 825,333

[22] Filed: Feb. 3, 1986

[51] Int. Cl.[4] ..... G01N 33/24

[52] U.S. Cl. ..... 73/784; 73/151

[58] Field of Search ..... 73/784, 151; 417/225, 417/226, 227, 403, 63, 401, 459; 91/275, 1; 166/100

[56] References Cited

U.S. PATENT DOCUMENTS

| | | | |
|---|---|---|---|
| 2,381,929 | 8/1945 | Schlumberger | 166/100 |
| 2,539,292 | 1/1951 | Anderson | 417/225 |
| 2,777,425 | 1/1957 | Adams et al. | 91/275 |
| 2,959,226 | 11/1960 | Blood | 166/100 |
| 3,095,785 | 7/1963 | Cahill | 91/1 |
| 3,364,373 | 1/1968 | Comes . | |
| 3,572,114 | 3/1971 | Ruppenet et al. . | |
| 3,703,926 | 11/1972 | Roeder | 417/403 |
| 3,858,441 | 1/1975 | Comeau | 73/784 |
| 3,927,652 | 12/1975 | O'Neill | 123/457 |
| 3,961,524 | 6/1976 | de la Cruz . | |
| 4,196,619 | 4/1980 | Collins | 73/155 |
| 4,461,171 | 7/1984 | de la Cruz . | |
| 4,478,129 | 10/1984 | Hannes et al. | 91/1 |
| 4,493,614 | 1/1985 | Chu et al. | 417/415 |
| 4,594,899 | 6/1986 | Henke et al. | 73/784 |

FOREIGN PATENT DOCUMENTS

| | | | |
|---|---|---|---|
| 0729337 | 5/1980 | U.S.S.R. | 73/151 |

*Primary Examiner*—Jerry W. Myracle
*Assistant Examiner*—Robert R. Raevis
*Attorney, Agent, or Firm*—Berman, Aisenberg & Platt

[57] ABSTRACT

Apparatus for use in testing the mechanical behaviour and deformation characteristics of rocks and the like at various locations in a borehole comprises a pressure intensifier used in conjunction with a dilatometer head, the two being rigidly interconnected so as to be lowered into the borehole. The pressure intensifier comprises a cylindrical housing providing upper and lower cylinders, and a double action piston which provides a 6 to 1 differential between the input pressure side and the output pressure side. Pressure changes are measured by means of a pressure transducer, and volumetric changes are determined from measurements of the linear displacement of the piston. Such linear displacements are measured by means of a shaft encoder coupled to a motion translating device for translating linear displacement into rotary displacement.

15 Claims, 2 Drawing Sheets

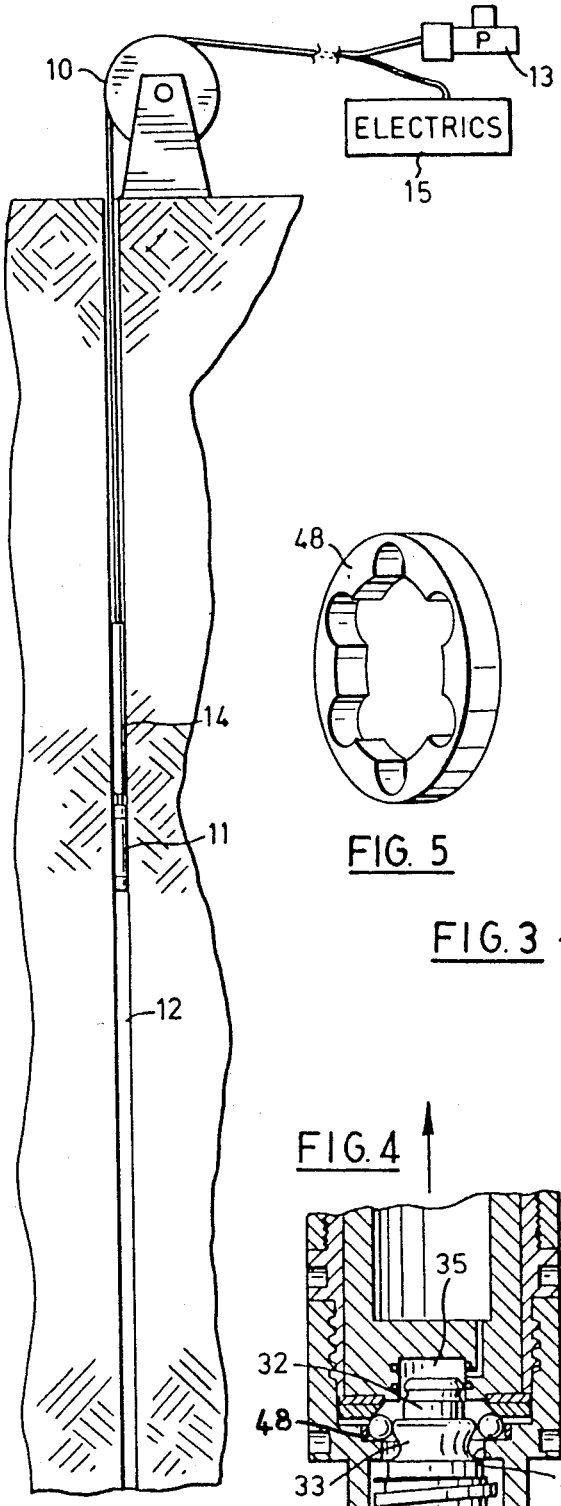
FIG. 1
FIG. 5
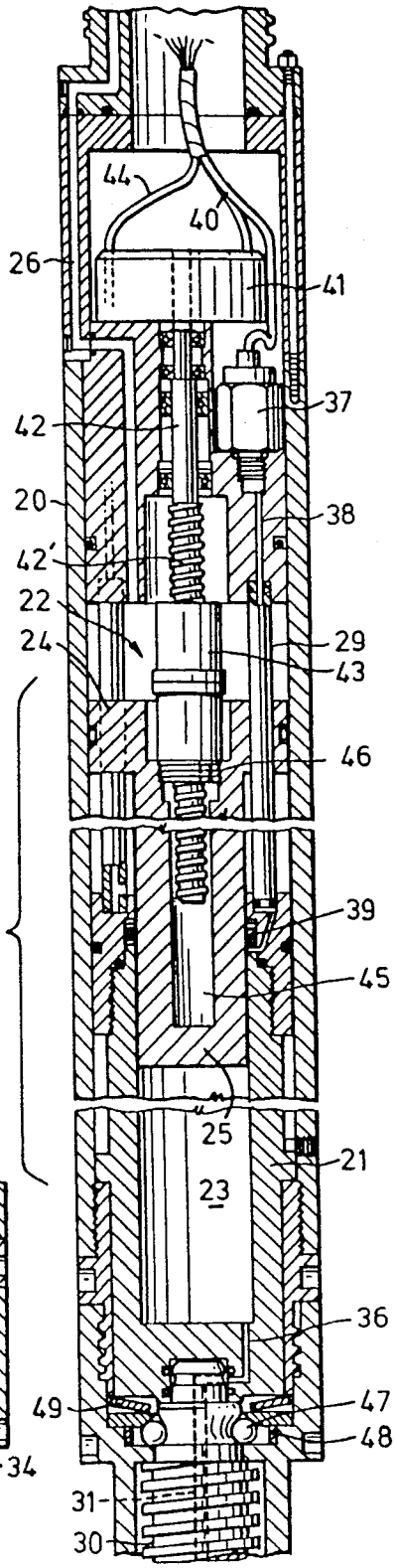
FIG. 3
FIG. 4
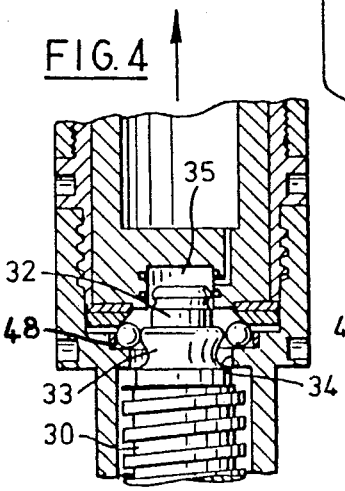

BOREHOLE DILATOMETER WITH INTENSIFIER

This invention relates to an apparatus for use in testing the mechanical behaviour and deformation characteristics of rocks and like materials at various locations in a borehole.

The apparatus is used in conjunction with a dilatometer, which is lowered into the borehole to a selected depth, the dilatometer head being internally pressurized by hydraulic fluid so as to be expanded radially against the wall of the borehole. Rock properties can be determined by correlating the volumetric changes of the dilatometer head with the applied hydraulic pressure. Hitherto, in such procedures, difficulties arising from several causes have been encountered. In the first place, the high hydraulic pressures often required cause hazardous working conditions above ground where the pressure source is located. Another difficulty, particularly in the case of deep borehole measurements where highly viscous fluids cannot be used satisfactorily, is that the use of a less viscous liquid such as water detracts from the stiffness of the system, owing to the compressibility of the liquid, rendering the system unsuitable for testing hard rocks such as granite.

The present invention relates to an apparatus which largely overcomes these difficulties. Essentially, the invention provides a pressure intensifier which can be interconnected with the dilatometer head and lowered with it as a unit into the borehole, thereby eliminating the need for high working pressures above ground and so allowing safer working conditions for personnel.

Another feature of the apparatus is that it allows highly viscous fluids such as oil, with its low compressibility, to be used instead of water since the need for high pressure tubing with its characteristic small inner diameter is eliminated.

An apparatus according to the present invention basically comprises a pressure intensifier to be used in conjunction with a dilatometer head which is lowered into the borehole to the required location. The dilatometer head has a radially expandable body portion defining an internal cavity for receiving hydraulic fluid under pressure. The pressure intensifier comprises, in combination: a housing defining first and second axially aligned interconnecting cylinders, the first cylinder being of larger diameter than the second cylinder; connecting means for establishing fluid communication between the second cylinder and the internal cavity of the dilatometer head; a piston having a head portion mounted for non-rotational linear reciprocation within the first cylinder so as to define a first chamber of variable volume ahead of the head portion, and a rearwardly extending plunger portion mounted for simultaneous linear reciprocation within the second cylinder so as to define a second chamber of variable volume rearwardly of the plunger portion; means for introducing a first hydraulic working fluid into the first chamber; means for pressurizing the first working fluid within the first chamber so as to displace the head portion of the piston linearly in the rearward direction, thereby pressurizing a second working fluid in the second chamber; means for measuring the linear displacement of the piston and for providing an electrical signal indicative thereof; and transducer means for measuring pressure changes of the second hydraulic fluid and for providing an electrical signal indicative thereof.

The invention is characterized by the fact that the linear displacement measuring means comprises a shaft encoder fixedly mounted in the housing, the shaft encoder being coupled to an axially extending shaft journalled for rotation within the housing. The shaft is coupled to the piston by motion translating means for effecting rotational displacement of the shaft is response to linear displacement of the piston. In a preferred embodiment of the invention the shaft has a helically threaded portion which is engaged by a ball screw assembly connected to the piston so as to be displaceable axially therewith thereby effecting rotational displacement of the shaft in response to linear displacement of the piston.

The second hydraulic working fluid may be water, at least if high system stiffness is not essential. However, the apparatus makes it possible to use highly viscous fluids such as oil, which is about half as compressible as water, in applications where system stiffness is important.

A preferred feature of the invention is that the pressure intensifier is releasably connected to the dilatometer head in such a way that, should the dilatometer head become lodged in the borehole, the pressure intensifier can be hoisted out separately and the dilatometer head can be retrieved subsequently by drillrods.

One embodiment of the invention will now be described, by way of example, with reference to the accompanying drawings.

IN THE DRAWINGS

FIG. 1 is a schematic diagram showing the use of the apparatus in conjunction with a dilatometer head, the dilatometer head being located in a borehole;

FIG. 3 is a longitudinal sectional view of the pressure intensifier;

FIG. 4 is a detail of FIG. 3 showing the operation of the quick release fastening means;

FIG. 5 illustrates a detail of the quick release fastening means;

Figure 6:
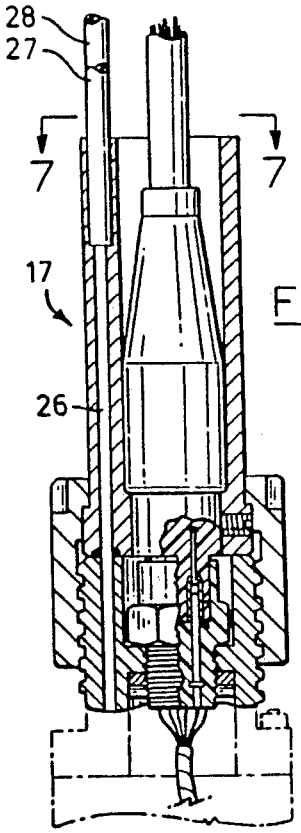
FIG. 6 is a longitudinal sectional view of a detail of FIG. 1, showing hydraulic and electrical connections to the pressure intensifier.
Figure 7:
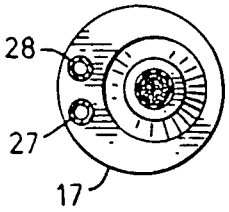
FIG. 7 is a section on line 7—7 in FIG. 6.
Figure 8:
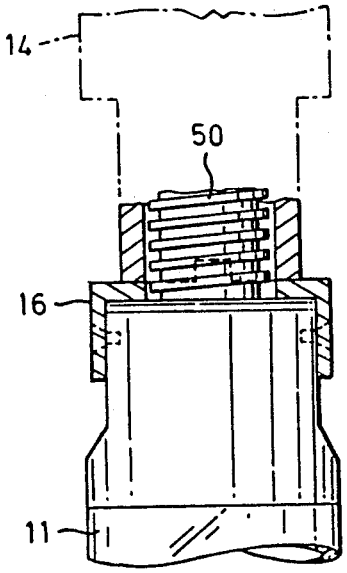
FIG. 8 shows a detail of the connection between the pressure intensifier and the dilatometer head.

Referring to FIG. 1, a hoist 10 at ground level is used to lower the dilatometer head 11 to the selected location in a borehole 12, the borehole 12 being drilled vertically into the ground. The dilatometer is of the type having an expandible body portion defining an internal cavity, which can be internally pressurized by hydraulic fluid so as to expand the body portion radially against the wall of the borehole. One such dilatometer head for this purpose is disclosed in our copending application Ser. No. 790,234 filed Oct. 18, 1985, the contents of which are incorporated herein by reference. A hydraulic pump 13 is used to supply hydraulic fluid under pressure to a pressure intensifier 14, the latter being rigidly interconnected with the dilatometer head 11 and operable to internally pressurize the latter. As hereinafter described, a pressure transducer mounted in the pressure intensifier housing is operable to measure pressure changes on the high pressure side of the intensifier and to provide an electrical signal indicative thereof. Volumetric changes of the dilatometer are determined from linear movements of a piston within the intensifier housing, means being provided for producing an electrical signal indicative thereof. The electrical signals are transmitted to a signal processing apparatus 15 whereby the signals are processed to obtain the required measurements of rock properties.

By reason of the fact that the dilatometer head and the pressure intensifier are rigidly interconnected and lowered into the borehole as a unit, the high working fluid pressures are confined below ground, only the fluid on the low pressure side of the intensifier being taken above ground level. Furthermore, pressure changes and volume changes are measured directly within the intensifier housing and converted to electrical signals which are safely transmitted by cable to the signal processing apparatus 15.

Figure 2:
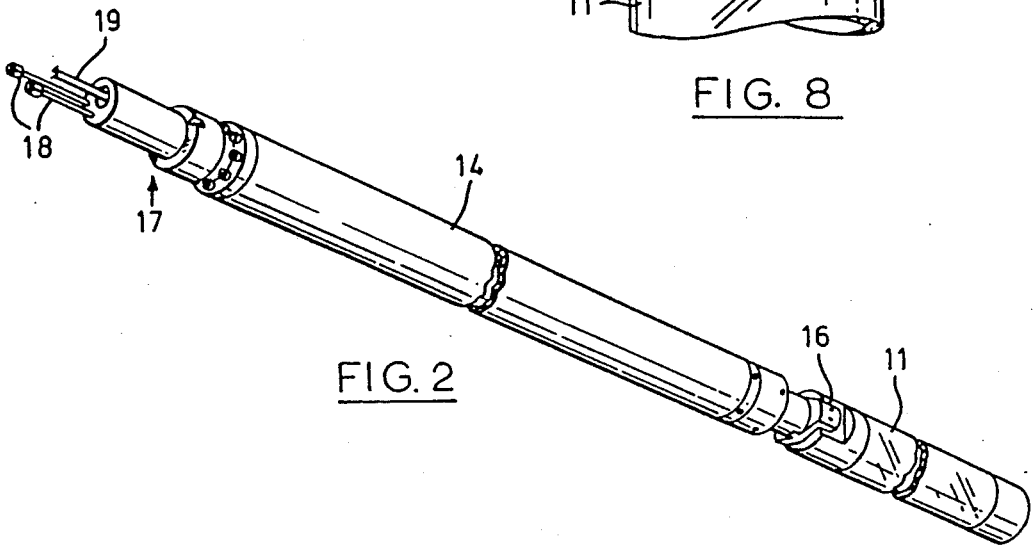
FIG. 2 is a perspective view, partly broken, of the pressure intensifier with a dilatometer head coupled thereto.

As shown in FIG. 2, the pressure intensifier 14 is hydraulically and mechanically connected to the dilatometer head 11 by a yoke fastening 16 at the lower end of the intensifier. At the upper end of the intensifier 14 is a coupling assembly 17 which carries both the hydraulic connections 18 on the low pressure side of the intensifier 14, and the electrical connections 19 which transmit signals to the signal processing apparatus 15 of FIG. 1.

Referring now also to FIGS. 3 to 8, the pressure intensifier 14 comprises an elongate cylindrical housing 20, within which a hollow insert 21 is located adjacent the lower end of the housing. The insert 21 defines together with the housing an upper cylinder 22 and a lower cylinder 23 interconnected with it. The cylinders 22 and 23 are axially aligned, the upper cylinder being of larger diameter than the lower cylinder 23. A piston having a head portion 24 and a downwardly directed plunger portion 25 is mounted in the housing 20 for linear reciprocation therein. The piston is constrained not to rotate by means of axially extending guide tubes 29 rigidly mounted within the housing, the guide tubes 29 registering with, and extending through, cooperating bores in the head portion 24 of the piston. The head portion 24 of the piston is thus constrained to reciprocate linearly within the upper cylinder 22 so as to define a first chamber of variable volume above the head portion. The plunger 25, being integral with the head portion of the piston, is constrained for simultaneous linear reciprocation within the lower cylinder 23, so as to define a second chamber of variable volume below the plunger.

A first hydraulic fluid is introduced into the first or upper chamber via a fluid passage 26 communicating with an inlet tube 27, the first hydraulic working fluid being introduced under pressure by the pump 13. A return fluid passage (not shown) communicates with an outlet tube 28. The tubes 27, 28 are interconnected with the pressure source represented by the pump 13.

In use of the apparatus, the second chamber defined by the plunger 25 and lower cylinder 23 is filled with a second working hydraulic fluid, which may be the same as or different from the first working fluid. The head portion 24 and plunger portion 25 are dimensioned so as to provide a 6 to 1 double action piston differential between the input pressure side of the intensifier and the output pressure side. The pressure intensifier 14 is rigidly interconnected with the dilatometer head 11 by means of a rigid shaft 30 providing an internal passageway 31 communicating with the internal cavity of the dilatometer head. The shaft has a coupling head 32 at its upper end, the coupling head being formed with an annular detent 33. The lower end of the cylindrical housing 20 of the intensifier has a circular opening 34 through which the coupling head extends, the coupling head being retained in cooperative engagement with an external socket 35 provided on the underside of the lower end of the insert 21. The insert 21 is formed with an internal passageway 36 communicating with the second chamber formed by the lower cylinder 23, and the coupling head 32 and socket 35 provide respective cooperating ports which interconnect the passageways 31 and 36 when the coupling head and socket means are mutually engaged as shown in FIG. 3. Thus, fluid communication between the lower cylinder 23 of the intensifier and the internal cavity of the dilatometer head is established by the passageways 31 and 36, and the cooperating ports.

The hydraulic pressure on the high pressure side of the intensifier, that is, in the cylinder 23 which communicates with the dilatometer head is measured by means of a pressure transducer 37 mounted in the intensifier housing. The transducer 37 is interconnected with the lower chamber formed by cylinder 23 by means of a passageway 38 extending through one of the guide tubes 29. A high pressure seal 39 engages the side of the plunger 25 immediately above the lower end of the passageway 38, there being a small clearance between the plunger and the cylinder wall forming, in effect, an extension of the passageway 38 to the chamber formed in cylinder 23. The pressure transducer 37, which may be of the ET/ETM-375 series manufactured by Kulite. provides output leads 40 for transmitting the pressure-dependent electrical output signal to the processing unit 15.

Volumetric changes of the dilatometer head are determined from measurements of the linear displacements of the plunger 25 in the cylinder 23. Such linear displacements are measured by means of an incremental shaft encoder, which may be of type LC-23 of Durham Instruments, a division of Buchan Instruments Inc. The shaft encoder 41 is fixedly mounted within the housing 20 near its upper end, and is coupled to an axially extending shaft 42 which is journalled within the housing for rotation about its axis. The shaft is coupled to the piston 24, 25 by means of a ball screw assembly 43. The ball screw assembly 43 may be of a type manufactured by Warner Electric Brake & Clutch Company. The axially extending shaft 42 has a helically threaded portion 42', the balls of the ball screw assembly engaging the helically threaded portion 42'. The housing of the assembly 43 is connected to the piston 24, 25 so as to be diplaceable axially therewith thereby to effect rotational displacement of the shaft 42 in response to linear displacement of the piston. The rotational displacement of the shaft 42 is converted to an electrical signal by the shaft encoder 41, the signal being transmitted through leads 44 to the processing unit 15.

As shown in FIG. 3, the piston 24, 25 has an axially extending bore 45 which opens into the upper chamber 22 at its upper end and is closed at its lower end. The shaft 42 extends into the bore 45, the housing of the ball screw assembly 43 having a threaded portion 46 which is threaded into the upper end of the piston.

The structure of the pressure intensifier further comprises a spring-loaded releasable fastening means located at the bottom of the cylindrical housing 20. The fastening means comprises a ball assembly 47 retained in a race 48 (FIG. 5), and a spring-loaded washer 49 which biasses the balls 47 radially inwardly into fastening engagement with the detent. With this arrangement, should the dilatometer head become lodged in the borehole, the intensifier can be readily released from it and hoisted from the borehole. The shaft 30, which is connected to the dilatometer head by the yoke fastening 16, has a helically threaded portion 50 which is adapted for engagement by a suitable retrieval tool, such as a drill rod, for retrieving the dilatometer head from the borehole.

Although the invention has been particularly described with reference to a dilatometer head which is lowered into a vertical borehole, it is to be understood that, so far as the structure of the pressure intensifier is concerned, the orientation of the borehole is immaterial. The subject of the present invention is the pressure intensifier as defined by the claims herein.

What we claim is:

1. In combination with a borehole dilatometer head having an expandable portion defining an internal cavity, a pressure intensifier for pressurizing the dilatometer head, the pressure intensifier being rigidly interconnected with the dilatometer head and forming therewith a composite unit to be lowered into a borehole, the intensifier comprising, in combination;

a housing for the pressure intensifier defining first and second axially aligned interconnecting cylinders, said first cylinder being of larger diameter than said second cylinder;

connecting means for establishing fluid communication between said second cylinder and said internal cavity of the dilatometer;

a piston having a head portion mounted for non-rotational linear reciprocation within the first cylinder so as to define a first chamber of variable volume ahead of the head portion, and a rearwardly extending plunger portion mounted for simultaneous linear reciprocation within the second cylinder so as to define a second chamber of variable volume rearwardly of said plunger portion;

means for introducing a first hydraulic working fluid into said first chamber;

means for pressurizing the first working fluid within the first chamber so as to displace the head portion linearly in the rearward direction, thereby pressurizing a second working fluid within the second chamber;

means for measuring the linear displacement of the piston and for providing an electrical signal indicative thereof; and transducer means attached to the pressure intensifier within the borehole for downhole sensing and for measuring pressure changes of the second working fluid and for providing an electrical signal indicative thereof, said linear displacement measuring means comprising a shaft encoder fixedly mounted in the housing, the encoder being coupled to an axially extending shaft journalled for rotation within the housing, said shaft being coupled to the piston by motion translating means for effecting rotational displacement of the shaft in response to axial displacement of the piston.

2. The combination claimed in claim 1, wherein the shaft has a helically threaded portion, and said motion translating means comprises a ball screw assembly engaging said helically threaded portion, the ball screw assembly being connected to the piston so as to be displaceable axially therewith thereby to effect said rotational displacement of the shaft in response to linear displacement of the piston.

3. The combination claimed in claim 2, further comprising axially extending guide means within the housing, the piston engaging said guide means and being constrained thereby for non-rotational linear reciprocation.

4. The combination claimed in claim 3, wherein the piston has an axially extending bore opening at one end into said first chamber and closed at its other end, said axially extending shaft extending into said bore.

5. In combination with a borehole dilatometer head having an expandable body portion defining an internal cavity, a pressure intensifier for pressurizing the dilatometer head, the pressure intensifier being rigidly interconnected with the dilatometer head and forming therewith a composite unit to be lowered into a borehole, the intensifier comprising, in combination:

a cylindrical housing for the pressure intensifier having upper and lower ends;

a hollow insert located within the housing adjacent the lower end of said housing and defining within the housing upper and lower axially aligned interconnecting cylinders, said upper cylinder being of larger diameter than said lower cylinder;

connecting means for establishing fluid communication between said lower cylinder and said internal cavity of the dilatometer head;

a piston having a head portion and a downwardly directed plunger portion, the piston being mounted for non-rotational linear reciprocation of the head portion within the upper cylinder so as to define a first chamber of variable volume above the head portion, the plunger portion being mounted for simultaneous linear reciprocation within the lower cylinder so as to define a second chamber of variable volume downwardly of said plunger portion;

means for introducing a first hydraulic working liquid into said first chamber;

means for pressurizing the first working liquid within the first chamber so as to displace the head portion linearly in the downward direction, thereby pressurizing a second working liquid within the second chamber;

transducer means for measuring the linear displacement of the piston and for providing an electrical signal indicative thereof; and second transducer means attached to the pressure intensifier within the borehole for downhole sensing and for measuring pressure changes of the second working liquid and for providing an electrical signal indicative thereof, said linear displacement measuring means comprising a shaft encoder fixedly mounted in the housing adjacent the upper end thereof, the encoder being coupled to an axially extending shaft journalled for rotation within the housing, and motion translating means interconnected between the shaft and the piston for effecting rotational displacement of the shaft in response to axial displacement of the piston.

6. The combination claimed in claim 5, wherein the shaft has a helically threaded portion, and said motion translating means comprises a ball screw assembly engaging said helically threaded portion, the ball screw assembly being connected to the piston so as to be displaceable axially therewith thereby to effect said rotational displacement of the shaft in response to linear displacement of the piston.

7. The combination claimed in claim 6, further comprising axially extending guide means within the housing, the piston engaging said guide means and being constrained thereby for non-rotational linear reciprocation.

8. The combination claimed in claim 7, wherein:

(a) said connecting means comprises a rigid shaft providing an internal passageway communication with said internal cavity, the shaft having a coupling head at one end, the coupling head extending through an opening at the lower end of said cylindrical housing, (b) said hollow insert provides an internal passageway communicating with said second chamber, and further provides an external socket into which said coupling head extends, and (c) said coupling head and socket provide respective cooperating ports whereby said passageways are interconnected when the coupling head and socket are mutually engaged, the intensifier further comprising spring-loaded releasable fastening means located at the bottom of the cylindrical housing and engaging the coupling head for releasably retaining the coupling head in cooperative engagement with the socket.

9. The combination claimed in claim 8, wherein the coupling head is formed with an annular detent, said fastening means comprising a ball assembly, means retaining the balls of said assembly at a selected location adjacent the lower end of the housing, and spring means biasing the balls radially inwardly into fastening engagement with the detent.

10. The combination claimed in claim 9, wherein said rigid shaft has a helically threaded portion adapted for engagement by a retrieval tool for retrieving the dilatometer head from the borehole in the event that the shaft is released from the intensifier.

11. In combination with a borehole dilatometer head having an expandable body portion defining an internal cavity, a pressure intensifier for pressurizing the dilatometer head, the pressure intensifier being rigidly interconnected with the dilatometer head and forming therewith a composite unit to be lowered into a borehole, the intensifier comprising, in combination:

a housing for the pressure intensifier defining first and second axially aligned interconnecting cylinders, connecting means for establishing fluid communication between said second cylinder of the intensifier and said internal cavity of the dilatometer head, comprising a rigid shaft having a coupling head at one end, the coupling head extending through an opening at the lower end of said housing, wherein said rigid shaft has a helically threaded portion adapted for engagement by a retrieval tool for retrieving the dilatometer head from the borehole in the event that the shaft is released from the intensifier.

12. The combination claimed in claim 11, wherein the coupling head is formed with an annular detent, said connecting means including a ball assembly, means retaining the balls of said assembly at a selected location adjacent the lower end of the housing, and spring means biasing the balls radially inwardly into fastening engagement with the detent.

13. In combination with a borehole dilatometer head having an expandable body portion defining an internal cavity, a pressure intensifier for pressurizing the dilatometer head, the pressure intensifier being rigidly interconnected with the dilatometer head and forming therewith a composite unit to be lowered into a borehole, the intensifier comprising, in combination;

a cylindrical housing for the pressure intensifier having upper and lower ends;

a hollow insert located within the housing adjacent the lower end of said housing and defining within the housing upper and lower axially aligned interconnecting cylinder, said upper cylinder being of larger diameter than said lower cylinder;

connecting means for establishing fluid communication between said lower cylinder of the intensifier and said internal cavity of the dilatometer head;

wherein said connecting means comprises a rigid shaft providing an internal passageway communicating with said internal cavity, the shaft having a coupling head at one end, the coupling head extending through an opening at the lower end of said cylindrical housing, and said hollow insert provides an internal passageway communicating with said second chamber, and further provides an external socket into which said coupling head extends.

14. The combination claimed in claim 13, wherein the coupling head and socket provide respective cooperating ports whereby said passageways are interconnected when the coupling head and socket are mutually engaged, the intensifier further comprising spring-loaded releasable fastening means located at the bottom of the cylindrical housing and engaging the coupling head for releasably retaining the coupling head in cooperative engagement with the socket.

15. The combination claimed in claim 14, wherein the coupling head is formed with an annular detent, said fastening means comprising a ball assembly, means retaining the balls of said assembly at a selected location adjacent the lower end of the housing, and spring means biasing the balls radially inwardly into fastening engagement with the detent.

* * * * *